US010689765B2

(12) United States Patent
Watanabe

(10) Patent No.: US 10,689,765 B2
(45) Date of Patent: Jun. 23, 2020

(54) METHOD FOR CLEANING WIRE AND DEVICE THEREFOR

(71) Applicants: Nakagawa Special Steel Inc., Tokyo (JP); Toyofumi Watanabe, Tokyo (JP)

(72) Inventor: Toyofumi Watanabe, Tokyo (JP)

(73) Assignees: Nakagawa Special Steel Inc., Tokyo (JP); Toyofumi Watanabe, Tokyo (JP)

( * ) Notice: Subject to any disclaimer, the term of this patent is extended or adjusted under 35 U.S.C. 154(b) by 0 days.

(21) Appl. No.: 15/509,878

(22) PCT Filed: Sep. 10, 2014

(86) PCT No.: PCT/JP2014/073897

§ 371 (c)(1),
(2) Date: Mar. 9, 2017

(87) PCT Pub. No.: WO2016/038701

PCT Pub. Date: Mar. 17, 2016

(65) Prior Publication Data

US 2017/0306508 A1 Oct. 26, 2017

(51) Int. Cl.

| | |
|---|---|
| ***C23G 1/02*** | (2006.01) |
| ***C23G 1/08*** | (2006.01) |
| ***C23G 3/02*** | (2006.01) |
| ***B08B 3/02*** | (2006.01) |
| ***B08B 3/04*** | (2006.01) |
| ***B08B 3/14*** | (2006.01) |

(52) U.S. Cl.

CPC ..... *C23G 1/08* (2013.01); *B08B 3/02* (2013.01); *B08B 3/048* (2013.01); *B08B 3/14* (2013.01); *C23G 3/023* (2013.01); *C23G 3/024* (2013.01)

(58) Field of Classification Search

CPC ..... C23C 2/02

See application file for complete search history.

(56) References Cited

U.S. PATENT DOCUMENTS 2,213,952 A * 9/1940 Clifford ..... C23C 2/02 427/292
2,235,825 A * 3/1941 Cary ..... C23C 22/74 188/3 H (Continued)

FOREIGN PATENT DOCUMENTS

CA 2308777 A1 11/1998
CN 101665946 A 3/2010

(Continued)

OTHER PUBLICATIONS

Machine Translation JPS5976685.*

(Continued)

*Primary Examiner* — David P Turocy
(74) *Attorney, Agent, or Firm* — The Webb Law Firm

(57) ABSTRACT

This method for cleaning wires enables effective descaling and removal of smuts from wires, prevents yellowing after cleaning, and significantly reduces the amount of water discharged as a result of cleaning, said method including, in the stated order: (A) pickling a wire; (B) cleaning the wire with acidic pressurized water, the concentration of which is adjusted with water and collected pickle solution which has adhered to and been recovered by the wire after use in Step (A); and (C) cleaning the wire with water.

4 Claims, 4 Drawing Sheets

ACID PICKLING AND COATING SYSTEM

(56) References Cited

U.S. PATENT DOCUMENTS

| | | | | | |
|---|---|---|---|---|---|
| 2,668,130 | A * | 2/1954 | Martin | C23G 1/36 | 134/13 |
| 3,501,347 | A * | 3/1970 | Kenmore | B08B 3/12 | 134/14 |
| 3,623,532 | A * | 11/1971 | Cofer | B21B 45/08 | 164/476 |
| 4,039,349 | A * | 8/1977 | Kwasnoski | B08B 3/022 | 134/10 |
| 4,197,139 | A * | 4/1980 | Hjersted | C23G 1/36 | 134/12 |
| 4,319,930 | A * | 3/1982 | Yano | B08B 3/022 | 134/10 |
| 4,388,169 | A * | 6/1983 | Nagira | C21D 9/56 | 204/207 |
| 5,837,061 | A * | 11/1998 | Karner | B08B 3/022 | 134/3 |
| 5,904,157 | A * | 5/1999 | Meseha | B08B 3/02 | 134/2 |
| 2002/0130666 | A1* | 9/2002 | Nonaka | C23G 1/02 | 324/468 |
| 2004/0226579 | A1* | 11/2004 | Starcevic | C23G 3/02 | 134/15 |
| 2005/0118809 | A1 | 6/2005 | Noguchi et al. | | |
| 2015/0013716 | A1* | 1/2015 | Masuoka | C22C 38/02 | 134/3 |

FOREIGN PATENT DOCUMENTS

| | | | | | |
|---|---|---|---|---|---|
| CN | 101961736 | A | | 2/2011 | |
| CN | 201817568 | U | | 5/2011 | |
| CN | 102337548 | A | | 2/2012 | |
| CN | 203700529 | U | | 7/2014 | |
| EP | 0595686 | A1 | | 5/1994 | |
| JP | 5896883 | A | | 6/1983 | |
| JP | 5976885 | A | | 5/1984 | |
| JP | 59076885 | A | * | 5/1984 | |
| JP | 59076885 | A | * | 5/1984 | C23G 3/027 |
| JP | S5976885 | A | * | 5/1984 | |
| JP | 60152318 | A | | 8/1985 | |
| JP | 02270977 | A | * | 11/1990 | C23G 3/029 |
| JP | H0448839 | B2 | * | 8/1992 | |
| JP | 4341590 | A | | 11/1992 | |
| JP | 5195268 | A | | 8/1993 | |
| JP | 09316670 | A | * | 12/1997 | |
| JP | 20001793 | A | | 1/2000 | |
| JP | 2001131785 | A | | 5/2001 | |
| JP | 2001284776 | A | | 10/2001 | |
| JP | 2002212767 | A | | 7/2002 | |
| JP | 2003193275 | A | * | 7/2003 | C23G 1/08 |
| JP | 2004306077 | A | * | 11/2004 | |
| JP | 20149370 | A | | 1/2014 | |
| JP | 201491859 | A | | 5/2014 | |
| TW | 200527594 | A | | 8/2005 | |
| WO | 9924643 | A1 | | 5/1999 | |

OTHER PUBLICATIONS

Machine Translation of JP59076885A, retrieved Mar. 2018 (Year: 2018).*
Machine Translation of JP 02270977, retrieved May 2019.*
Machine Translation of JP 2003193275, retrieved May 2019.*
Office Action for related Application No. CN 201480081784.3 dated Apr. 23, 2018.
Office Action for related Application No. MX/a/2017/003104 dated Mar. 21, 2018.

* cited by examiner

HIGH-PRESSURE CLEANING APPARATUS

CHANGES IN CONCENTRATION OF ACID PICKLING SOLUTION
IN HIGH-PRESSURE CLEANING APPARATUS

METHOD FOR CLEANING WIRE AND DEVICE THEREFOR

CROSS-REFERENCE TO RELATED APPLICATION

This application is the United States national phase of International Application No. PCT/JP2014/073897 filed Sep. 10, 2014, the disclosure of which is hereby incorporated in its entirety by reference.

TECHNICAL FIELD

The invention belongs to the technical field of wire rod cleaning methods, particularly, coiled wire rod cleaning methods. More specifically, the invention relates to a technique in which after acid pickling of wire rod, smut produced by the acid pickling is removed by high-pressure cleaning method with such an amount of water that it does not put a strain on a wastewater treatment system, and after the pickling, the surface of the wire rod is prevented from rusting.

BACKGROUND ART

In the field of wire rod secondary processing, wire rod after hot rolling is generally subjected to a series of treatments and processes such as heat treatment, acid pickling, coating treatment, and cold drawing so that tertiary processing can be easily performed to form parts.

For acid pickling of wire rod, batch processes are widely used, in which coiled wire rod is immersed as it is in an acid pickling solution. In a batch-type acid pickling process, coiled wire rod is generally put on a C type hook for carrying and transferring when immersed in a pickling tank. A series of acid pickling and coating processes generally include acid pickling with a solution of an acid such as hydrochloric acid or sulfuric acid in an acid pickling line, subsequent water washing, neutralization, and/or coating treatment, which are sequentially performed.

Acid pickling solutions used in acid pickling typically contain sulfuric acid or hydrochloric acid. When sulfuric acid is used, the sulfuric acid solution reaches the surface of the wire rod material through cracks in scale to dissolve the metal and produce hydrogen, so that the scale is removed from the surface of the wire rod. When hydrochloric acid is used in acid pickling, the hydrochloric acid solution reaches the surface of the material through cracks in scale to dissolve the metal and the scale.

In acid pickling solutions, the main chemical reactions occurring on the surface of wire rod are represented by the formula below.

(Dissolution of Steel: Anodic Reaction)

$$Fe \rightarrow Fe^{2+} + 2e \quad (1)$$

(Hydrogen Production: Cathodic Reaction)

$$2H^{+} + 2e \rightarrow H_2 \quad (2)$$

$$Fe_2O_3 + 6H^{+} + 2e \rightarrow 2Fe^{2+} + 3H_2O \quad (3)$$

$$Fe_3O_4 + 8H^{+} + 2e \rightarrow 3Fe^{2+} + 4H_2O \quad (4)$$

When sulfuric acid is used, reactions (1) and (2) mainly occur. When hydrochloric acid is used, reactions (1), (2), (3), and (4) occur. In reaction (1), non-uniform material erosion occurs, corresponding to the metal structure of steel, which can affect the surface roughness. After the pickling, the acid solution is washed away with water. In this process, however, brown or black smut can remain on the surface of steel to turn it to a dark color.

As used herein, the term "scale" refers to oxide produced on the surface of wire rod when the wire rod is rolled and annealed. The term "descaling" refers to removing the scale. The term "smut" is a generic name for black and brown substances that adhere to the surface of steel when scale and wire rod materials are dissolved by acid pickling. Carbon, Si, Cr, Mn, and other components contained in iron steel can form fine particles in scale layers, and iron ions in acid pickling solutions can re-precipitate as iron oxide and iron hydroxide on the surface of steel during water washing and drying. Smut is considered to be composed of such fine particles, iron oxide, and iron hydroxide. Non-uniform material erosion corresponding to the structure of steel can increase the surface roughness. Smut deposition can turn wire rod to a dark color, cause unevenness in the coating treatment, and create an uneven color appearance. It is therefore desired to reduce them.

Non-uniform material erosion, a disadvantage of acid pickling for descaling, should be reduced. For this purpose, many acid pickling inhibitors for reducing the erosion of steel materials are proposed, including nitrogen-containing compounds such as amine compounds, sulfur compounds such as thiourea derivatives, and surfactants. Unfortunately, such inhibitors all have the disadvantage that they can also change the descaling rate, and are not sufficiently effective. On the other hand, smut produced by acid pickling is generally removed using the physical effect of high-pressure water shower, for example, as shown in Patent Literature 1. However, this method uses a relatively large-scale facility or apparatus and also uses a large amount of water. Therefore, this method puts a high load on a wastewater treatment and other processes and also has a problem with cost. There is also the disadvantage that because the removal of smut is less stable, not only the color tone after the acid pickling cannot be kept constant, but also the subsequent coating treatment can be non-uniform, which has an adverse effect on drawing or tertiary processing. It is therefore desired to overcome the disadvantage.

In addition, after the acid pickling, wire rod is exposed to the air in the acid pickling line, so rust can be formed on its surface even while it is transferred to a water washing treatment before a neutralization or coating treatment. To prevent such rusting, for example, Patent Literature 2 discloses a method for preventing the surface of wire rod from rusting by a low-temperature, low-concentration, sulfuric acid treatment that includes immersing the wire rod in a low-temperature, low-concentration, sulfuric acid solution with a concentration of 1 to 10% and at a temperature of 0 to 50° C. after the acid pickling of the wire rod and then washing the wire rod with water, which is performed in a series of wire rod descaling steps including acid pickling, water washing, neutralizing, and coating steps.

Patent Literature 1 discloses a technology about a wire rod-rotating type pressurized water cleaner that is configured to rotate wire rod itself so that it can apply pressurized water almost equally to the whole of the wire rod and also configured to rotate deformed wire rod so that it can wash the wire rod with water while moving the wire rod. As mentioned above, however, this technology has the disadvantage that it puts a high load on the facility and apparatus, particularly, the wastewater treatment system.

According to Patent Literature 1, wire rod is rotated, and therefore the wire rod is washed with water while being moved, so that scale and smut adhering to the surface of coiled wire rod can be removed from the whole circumference of the wire rod. As this water washing becomes more satisfying, the surface of wire rod becomes more active, and the surface becomes rusty when it is exposed to the air during transfer from the water washing to neutralization, so that an undesirable appearance defect, what is called yellowing, is observed.

In a current common acid pickling process for wire rod, therefore, after the high-pressure water washing process disclosed in Patent Literature 1 is completed, the acid pickling line disclosed in Patent Literature 2 may be used to immerse the wire rod in the low-temperature, low-concentration, sulfuric acid solution after the acid pickling and before finish water washing, so that the surface of the wire rod can be prevented from rusting before the water washing and after the coating treatment by the use of the low-temperature, low-concentration, sulfuric acid treatment. However, when used together, both techniques require a large wastewater treatment facility and put a high load on a wastewater treatment system.

In an acid pickling and coating system for coiled wire rod, a cleaning step is commonly performed immediately after an acid pickling step so that the subsequent steps can be facilitated. There are several types of cleaning apparatuses used for such a purpose. Among them, a ring tube-type shower apparatus, which is designed to move its ring tube-shaped shower head along the axis of coiled wire rod while emitting a shower, becomes increasingly used instead of other type of shower apparatuses, because it can produce a high cleaning effect with small pump performance. However, such a shower apparatus still has the problem of rust formation during the shower process.

Patent Literature 3 discloses a system as a measure against rusting during the shower process performed using these shower apparatuses. In such a system, an auxiliary shower for preventing rusting is used in addition to the cleaning shower.

CITATION LIST

Patent Literatures

Patent Literature 1: JP 2001-131785 A
Patent Literature 2: JP 2000-1793 A
Patent Literature 3: JP 2002-212767 A

SUMMARY OF INVENTION

Technical Problem

High-pressure water washing can remove smut, and an auxiliary shower at a pH in a certain range can prevent the surface of wire rod from rusting. Even in such a case, however, the wastewater treatment facility is required to have a larger capacity.

Water washing with a high-pressure cleaning shower is generally performed, for example, using a pump with a performance of about 1,000 L/minute at a water pressure of 5 kg/cm$^2$, which corresponds to 50 meters of total head. If the inner and outer circumferences of wire rod are washed with water at 2,000 L/minute using two such pumps, it will be necessary to use up to about 3,000 m$^3$/day of water. The amount of water used for the cleaning shower varies with the amount treated per day and the time of the treatment with the cleaning shower. For example, assuming that the inner and outer circumferences are washed with high-pressure water at about 1,000 L/minute for 2 minutes every 7 minutes, about 800 m$^3$/day of water is necessary.

For the treatment of wastewater produced from such water washing, different countries or different local public entities such as prefectures or states generally have different emission standards. For example, in Japan, wastewater is allowed to flow into rivers if the oil content, metal ion concentration, and other indexes of the wastewater are controlled to not exceed the specified standard limits. However, there are even some countries, prefectures, or states requiring zero emission of wastewater. In such regions (e.g., India), it is necessary to use large wastewater treatment facilities and circulation facilities for reuse of wastewater. It is therefore very important in terms of compliance and cost to reduce the amount of wastewater.

It is therefore an object of the invention to provide a wire rod cleaning method that makes it possible not only to perform conventional tasks such as descaling of wire rod, removal of smut, and prevention of yellowing of materials but also to reduce the amount of wastewater produced.

Solution to Problem

As a result of earnest study, the inventor has accomplished the invention based on findings that the object can be achieved by a process that includes using, for example, hydrochloric acid, sulfuric acid, or the like in an acid pickling solution for descaling wire rod; subjecting wire rod to acid pickling with the acid pickling solution effective for descaling of the wire rod; applying pressurized water almost equally to the whole of the wire rod, for example, using a cleaning shower to remove smut, wherein the pressurized water is produced using the acid pickling solution adhering to the wire rod and has a certain acid concentration; and then washing the wire rod with water.

Specifically, the invention is directed to any of the following.

[1] A wire rod cleaning method including, in the following order, the steps of:

(A) subjecting a wire rod to acid pickling;

(B) cleaning the wire rod with pressurized acidic water, wherein the concentration of the acidic water is adjusted with an acid pickling solution that has been retrieved as being adhered to the wire rod and collected after it had been used in the step (A) and water; and (C) washing the wire rod with water.

[2] The cleaning method according to [1], wherein in the step (B), smut is removed from the wire rod.

[3] The cleaning method according to [1], wherein in the step (B), the pressurized acidic water contains 0.1% by mass to 15% by mass of hydrochloric acid or 0.2% by mass to 15% by mass of sulfuric acid.

[4] The cleaning method according to [1], wherein in the step (B), the pressurized acidic water has a pressure of 2 to 20 kg/cm$^2$.

[5] The cleaning method according to [1], wherein the wire rod is a coiled wire rod.

[6] The cleaning method according to [1], further including, following the steps (A) to (C) and in the following order, the steps:

(D) neutralizing the surface of the wire rod; and (E) forming a coating on the surface of the wire rod.

[7] The cleaning method according to [1], wherein in the step (A):

at least a first pickling tank and a second pickling tank are used;

the wire rod is subjected to acid pickling in the first pickling tank, then the wire rod is transferred to the second pickling tank, and the wire rod is further subjected to acid pickling in the second pickling tank; and the acid pickling solution overflowing from the second pickling tank is supplied to the first pickling tank.

[8] The cleaning method according to [7], wherein in the step (A):

a third pickling tank is further used;

the wire rod is transferred to the third pickling tank and subjected to acid pickling in the third pickling tank after the pickling in the second pickling tank; and the acid pickling solution overflowing from the third pickling tank is supplied to the second pickling tank.

[9] The cleaning method according to [1], wherein in the step (A):

two to six pickling tanks are used;

the wire rod is subjected to acid pickling in one of the two to six pickling tanks, then sequentially the wire rod is transferred to an adjacent another pickling tank and further subjected to acid pickling, so that the wire rod is subjected to acid pickling in all the two to six pickling tanks; and the acid pickling solution overflowing from one of the two to six pickling tanks are sequentially supplied to an adjacent another pickling tank in a direction opposite to that in which the wire rod is transferred, so that the acid pickling solution is supplied to all the two to six pickling tanks.

[10] A wire rod cleaning apparatus, including:

(a) at least one pickling tank;

(b) a high-pressure cleaning shower configured to perform cleaning with pressurized acidic water produced by diluting an acid used in the pickling tank;

(c) at least one water washing tank; and (d) transfer means configured to transfer a wire rod from the pickling tank (a) to the high-pressure cleaning shower (b) and from the high-pressure cleaning shower (b) to the water washing tank (c), respectively.

[11] The wire rod cleaning apparatus according to [10], wherein the at least one pickling tank (a) includes at least a first pickling tank and a second pickling tank, the wire rod cleaning apparatus further including a flow channel configured to supply an acid pickling solution from the second pickling tank to the first pickling tank, wherein the transfer means (d) is configured to transfer the wire rod from the first pickling tank to the second pickling tank.

[12] The wire rod cleaning apparatus according to [11], further including a third pickling tank and a flow channel configured to supply the acid pickling solution from the third pickling tank to the second pickling tank, wherein the transfer means (d) is configured to transfer the wire rod from the second pickling tank to the third pickling tank.

[13] The wire rod cleaning apparatus according to [10], wherein the at least one pickling tank (a) includes two to six pickling tanks, the wire rod cleaning apparatus further including a flow channel configured to sequentially supply an acid pickling solution from one of the two to six pickling tanks to adjacent another pickling tank, wherein the transfer means (d) is configured to sequentially transfer the wire rod from one of the two to six pickling tanks to an adjacent another pickling tank in a direction opposite to that in which the acid pickling solution is supplied.

[14] The wire rod cleaning apparatus according to any one of [10] to [13], further including (e) at least one neutralization tank and/or (f) means for forming a coating.

Advantageous Effects of Invention

The wire rod cleaning method of the invention makes it possible to appropriately remove scale and smut from wire rod, prevent the wire rod from turning yellow after cleaning, and significantly reduce the amount of wastewater produced by the cleaning.

DESCRIPTION OF EMBODIMENTS

Hereinafter, embodiments of the invention will be described in detail with reference to the drawings.

Figure 1:
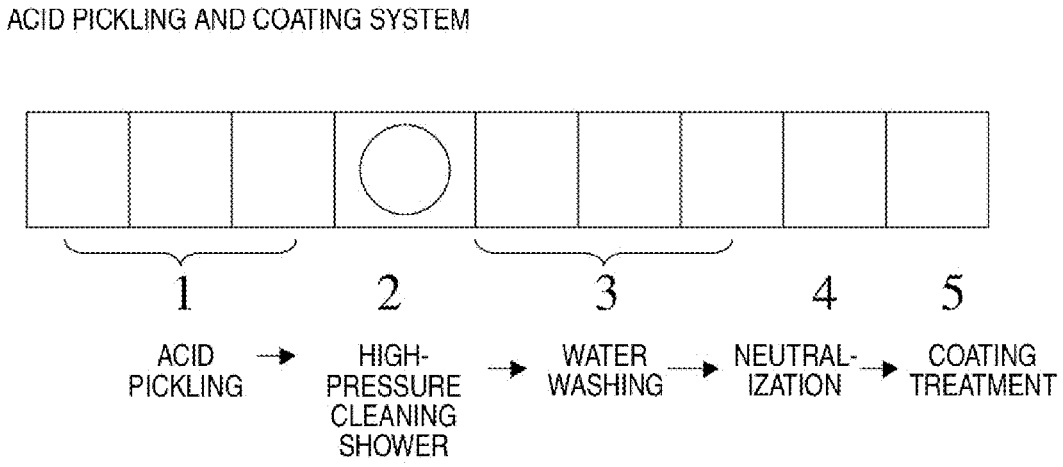
FIG. 1 is a schematic diagram showing the configuration of an acid pickling and coating system as an embodiment of the cleaning apparatus according to the invention.

FIG. 1 shows an example of an acid pickling and coating system for use in performing the method according to the invention. High-pressure cleaning shower cleaning with an acid pickling solution is incorporated in the acid pickling and coating system.

The invention is directed to a wire rod cleaning method including, in the following order, the steps of: (A) subjecting a wire rod to acid pickling; (B) cleaning the wire rod with pressurized acidic water, wherein the concentration of the acidic water is adjusted with an acid pickling solution that has been retrieved as being adhered to the wire rod and collected after it had been used in the step (A) and water; and (C) washing the wire rod with water.

[A. Acid Pickling Step]

In the acid pickling and coating system of FIG. 1, the step (A) of subjecting a wire rod to acid pickling is performed in a plurality of pickling tanks, for example, three pickling tanks, which are designated by "1 ACID PICKLING"

In the invention, the term "wire rod" refers to a wire-shaped steel material obtained through rolling, although in a broad sense, it refers to a wire-shaped metal material obtained through working. The cross-section of the wire rod generally has a diameter of about 4.5 mm to about 60 mm Its cross-section is circular in most cases, but may be hexagonal, square, or other shapes depending on the intended use. The wire rod is used as a material for wires, nails, bolts, bearings, wire nettings, chains, and other products.

The wire rod is often produced by hot rolling. More specifically, caliber rolling is generally used as the rolling method. During the hot rolling, scale can be formed on the surface. In general, scale is removed by acid pickling. Also in this embodiment, scale is removed from the wire rod in the step (A) of subjecting the wire rod to acid pickling.

The wire rod may be in any shape. In practical applications, coiled wire rod is most frequently used. The invention is also preferably applied to coiled wire rod.

In the invention, the step (A) of subjecting the wire rod to acid pickling may be performed by immersing the wire rod in an acid pickling solution. Hydrochloric acid or sulfuric acid is generally used for the acid pickling solution. Hydrochloric acid is preferably used, for example, because it can highly dissolve scale to provide a clean and smoothly-finished surface, so that the coating formed by the surface treatment can be thin. Sulfuric acid, which does not generate gas, is preferably used in view of working environment, the simplicity of the system, and prevention of building corrosion. They may also be used together.

At room temperature, hydrochloric acid is preferably used at a concentration of 5% by mass to 20% by mass, more preferably 10% by mass to 18% by mass. Sulfuric acid is preferably used at a concentration of 10% by mass to 25% by mass, more preferably 10% by mass to 20% by mass. When sulfuric acid is used, heating should be performed. More specifically, using the acid pickling solution having a concentration within the above range, scale can be uniformly removed in a specific period of time, which is advantageous.

In the invention, the step (A) of subjecting the wire rod to acid pickling preferably includes using at least two pickling tanks (first and second pickling tanks), subjecting the wire rod to acid pickling in the first pickling tank, then transferring the wire rod to the second pickling tank, and further subjecting the wire rod to acid pickling in the second pickling tank. The acid pickling solution overflowing from the second pickling tank is preferably supplied to the first pickling tank.

The advantageous effect that scale is uniformly removed is produced by subjecting the wire rod to acid pickling in a plurality of pickling tanks while transferring the wire rod between the pickling tanks. Also when a plurality of separate tanks are used, the content of $Fe^{2+}$ and Fe' iron ions in the acid pickling solution can vary from tank to tank. In this case, although the reason is not clear, the wire rod can have a suitable surface roughness, which can lead to the advantageous effect that the optional coating treatment can be uniformly performed.

After the wire rod is subjected to acid pickling in the first pickling tank, the acid pickling solution adhering to the wire rod from the first pickling tank is transferred to the second pickling tank when the wire rod is fed to the second pickling tank. This results in a reduction in the amount of the acid pickling solution in the first pickling tank. To supplement the reduced amount, the acid pickling solution overflowing from the second pickling tank is preferably supplied to the first pickling tank. This eliminates the need for the direct supply of the acid pickling solution to the first pickling tank for the purpose of supplementing the reduced amount of the acid pickling solution in the first pickling tank, which can produce the advantageous effect that the total amount of the acid pickling solution used can be saved and the amount of wastewater can also be reduced.

Additionally, when the amount of the acid pickling solution supplied to the second pickling tank is appropriately controlled in this process, the iron ion concentrations in the first and second pickling tanks can be controlled to certain different levels, respectively. This also produces the advantageous effect that the time and labor required for replacing the degraded acid pickling solution can be saved and uniform removal of scale and high surface uniformity can be achieved.

For the same reason as in the case that acid pickling is performed using at least two pickling tanks, the step (A) of subjecting the wire rod to acid pickling in the invention preferably includes using first, second, and third pickling tanks, subjecting the wire rod to acid pickling in the first pickling tank, then transferring the wire rod to the second pickling tank, subjecting the wire rod to acid pickling in the second pickling tank, then transferring the wire rod to the third pickling tank, and further subjecting the wire rod to acid pickling in the third pickling tank.

The acid pickling solution overflowing from the third pickling tank is also preferably supplied to the second pickling tank.

In the invention, any number of pickling tanks may be used in the step (A) of subjecting the wire rod to acid pickling. As described above, two or three pickling tanks may be used, or alternatively more than three (e.g., five) pickling tanks may be used. In the embodiment shown in FIG. 1, three pickling tanks are used (see 1 ACID PICKLING in FIG. 1). FIG. 1 shows a linear tank arrangement as a non-limiting example. Alternatively, a loop type acid pickling system may be used.

In the invention, the step (A) of subjecting the wire rod to acid pickling preferably includes using a plurality of pickling tanks, such as two to six pickling tanks, subjecting the wire rod to acid pickling in one of the two to six pickling tanks, then sequentially transferring the wire rod to an adjacent another pickling tank to further subject the wire rod to acid pickling, so that the wire rod is subjected to acid pickling in all the two to six pickling tanks, and sequentially supplying the acid pickling solution, overflowing from one of the two to six pickling tanks, to the adjacent another pickling tank in a direction opposite to that in which the wire rod is transferred, so that the acid pickling solution is supplied to all the two to six pickling tanks.

More specifically, for example, a first pickling tank (a1), a second pickling tank (a2), a third pickling tank (a3), a fourth pickling tank (a4), a fifth pickling tank (a5), and a sixth pickling tank (a6) may be used. In this case, a preferred process includes first subjecting the wire rod to acid pickling in the first pickling tank (a1), then transferring the wire rod to the adjacent second pickling tank (a2) and further subjecting the wire rod to acid pickling therein, and transferring the wire rod sequentially to other adjacent pickling tanks (a3), (a4), (a5), and (a6) to repeat acid pickling therein, while supplying the acid pickling solution, overflowing from one pickling tank (a6), to another adjacent pickling tank (a5) in a direction opposite to that in which the wire rod is transferred, and supplying the overflowing acid pickling solution sequentially to other adjacent pickling tanks (a4), (a3), (a2), and (a1) in a direction opposite to that in which the wire rod is transferred. The same applies also when the number of pickling tanks is further increased.

Methods for immersing the wire rod 11 in a plurality of pickling tanks include a method of dividing, by the number of tanks, the time period required for acid pickling and immersing the wire rod 11 in each tank for each corresponding time period to remove scale, and a method of immersing the wire rod in a single tank for a given time period. Any of these methods may be used in the invention. A preferred treatment includes immersing the rod wire sequentially in a plurality of tanks over the total immersion time. In this treatment, the wire rod is physically transferred, so that scale is uniformly removed from the wire rod. Also when a plurality of separate tanks are used, the content of $Fe^{2+}$ and $Fe^{3+}$ iron ions in the acid pickling solution can vary from tank to tank. Although the reason is not clear, it has been found that in this case, the wire rod has a suitable surface roughness, so that the coating treatment is uniformly performed.

[Transfer Means]

The means for transferring the wire rod from one pickling tank to another pickling tank may be any suitable means conventionally used in the field of the art.

Figure 2:
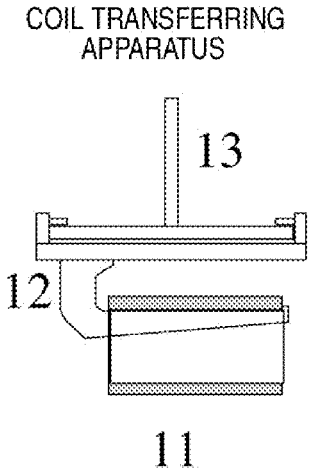
FIG. 2 is a schematic diagram showing the structure of a transfer means (coil transferring apparatus) used in an embodiment of the invention.

As shown in FIG. 2, for example, coiled wire rod 11 may be put on a C type hook 12 and transferred using a carrying and transferring apparatus 13. The transferred wire rod may be subjected to an acid pickling and coating process, for example, in a batch-type acid pickling and coating system as shown in FIG. 1.

[B. High-Pressure Cleaning Step]

In general, the wire rod, from which scale has been removed, has smut and the acid pickling solution adhering to its surface, while it is taken out of the pickling tank. In the invention, smut can be removed from the wire rod in the step (B) of cleaning the wire rod with pressurized acidic water, wherein the concentration of the acidic water is adjusted with water and the acid pickling solution that is retrieved and collected after it is used in the acid pickling step (A) and adheres to the wire rod (in the description, the step (B) is also referred to as the "high-pressure cleaning step").

After used in the acid pickling step (A), the acid pickling solution adhering to the wire rod is retrieved and collected to be used. This allows good use of the acid pickling solution, saving the amount of the acid pickling solution used, and reducing the amount of wastewater, which is practically advantageous. After used in the acid pickling step, the acid pickling solution adhering to the wire rod is retrieved, collected, and used again. This also eliminates the need for the provision of a separate line for supplying an acid pickling solution to the high-pressure cleaning step (B), which is also advantageous in reducing equipment costs.

The concentration of the pressurized acidic water is adjusted with water and the acid pickling solution, which is used on the wire rod, retrieved, and collected. Hydrochloric acid or sulfuric acid is preferably used for the pressurized acidic water. Hydrochloric acid or sulfuric acid is more preferably used at a concentration of 0.1% by mass to 15% by mass or a concentration of 0.2% by mass to 15% by mass, even more preferably used at a concentration of 1% by mass to 7% by mass or a concentration of 1.5% by mass to 10% by mass.

The pressurized acidic water used in the step (B) preferably has a pressure of 2 to 20 kg/cm$^2$, more preferably 3 to 15 kg/cm$^2$. Concerning the pressure, pressures in the field of pump technology are often expressed as total heads (in units of meters), and the pressure of 2 to 20 kg/cm$^2$ corresponds to a total head of about 20 to about 200 m.

When the acid concentration and the pressure fall within the ranges, there is obtained the advantageous effect that removal of smut and prevention of smut deposition can be effectively achieved and yellowing of the material can be effectively prevented.

The means for performing the step (B) of cleaning the wire rod with the pressurized acidic water may be any suitable means conventionally used for cleaning with pressurized water. For example, a high-pressure cleaning shower is preferably used.

In particular, a high-pressure cleaning apparatus as described in detail in EXAMPLES below is preferably used. In particular, the high-pressure cleaning apparatus is practically advantageous because it can effectively remove smut, prevent smut deposition, prevent yellowing of the material, and circulate and reuse a cleaning liquid so that the amount of wastewater can be small.

[C. Water Washing Step]

In the invention, the step (B) of cleaning the wire rod with pressurized acidic water is followed by the step (C) of washing the wire rod with water. In the step (B) of cleaning the wire rod with pressurized acidic water, smut is removed from the surface of the wire rod. In general, however, the surface of the wire rod in the step (B) is slightly acidic due to the pressurized acidic water and therefore is not suitable as it is for use in a downstream process.

The method of washing with water may be, but not limited to, immersing the wire rod in a water washing tank for a certain period of time. The number of water washing tanks is not restricted. A single water washing tank may be used alone. Alternatively, a plurality of water washing tanks may be used, and the wire rod may be washed with water and transferred between the water washing tanks.

In the embodiment shown in FIG. 1, three water washing tanks are provided, in which the wire rod is washed with water and transferred from one to another.

Similarly to the step (A) of subjecting the wire rod to acid pickling, the following events occur in the step (C) of washing the wire rod with water. After the wire rod is washed with water in the first water washing tank, the water (containing acid) adhering to the wire rod from the first water washing tank is transferred to the second water washing tank when the wire rod is fed to the second water washing tank. This results in a reduction in the amount of water in the first water washing tank. To supplement the reduced amount, the water overflowing from the second water washing tank is preferably supplied to the first water washing tank. This can produce the advantageous effect that the total amount of water used can be saved and the amount of wastewater can be reduced.

While an example where two water washing tanks (first and second water washing tanks) are used has been described, three or more water washing tanks can also be used advantageously. The section "EXAMPLES" below will show an example using three water washing tanks to demonstrate the effect of reducing the amount of wastewater.

The wire rod cleaning method of the invention preferably includes, in the following order, the steps of (A) subjecting wire rod to acid pickling, (B) cleaning the wire rod with pressurized acidic water, (C) washing the wire rod with water, and (D) then neutralizing the surface of the wire rod and/or (E) then forming a coating on the surface of the wire rod.

In the invention, the step (D) of neutralizing the surface of the wire rod is preferably used. The method used in the step (D) may be any suitable neutralization method conventionally used, in the field of the art, as a treatment step when wire rod is fed to an annealing step after acid pickling. For example, a method of neutralization with a diluted aqueous solution of potassium hydroxide may be used.

In the invention, the step (E) of forming a coating on the surface of the wire rod is preferably used. The method used in the step (E) may be any suitable coating-forming method conventionally used in the field of the art. For example, a coating may be deposited by a treatment with lime soap and/or a phosphate, which can be used as a lubricant in cold drawing.

When the step (E) of forming a coating on the surface of the wire rod is used in the invention, it should be noted that the amount of wastewater in the coating formation treatment should be reduced or not increased so that the invention can remain effective in reducing the amount of wastewater.

According to an embodiment of the invention, the amount of wastewater produced in the steps (B) and (C) will be 60 $m^3$ to 80 $m^3$, although it depends on the amount and diameter of the wire rod treated, assuming that about 200 tons of wire rod per day is washed with water at a rate of 1,000 L/minute while its inner and outer surfaces are washed at the same time. This amount of wastewater is ⅛ to 1/10 of that (500 $m^3$ to 700 $m^3$) produced when similar steps are performed according to a conventional technique. Therefore, the invention allows a significant reduction in wastewater treatment facility cost and makes it easier to comply with environmental laws and standards.

Another embodiment of the invention is directed to a wire rod cleaning apparatus including: (a) at least one pickling tank; (b) a high-pressure cleaning shower configured to perform cleaning with pressurized acidic water produced by diluting an acid used in the pickling tank; (c) at least one water washing tank; and (d) transfer means capable of transferring a wire rod from the pickling tank (a) to the high-pressure cleaning shower (b) and from the high-pressure cleaning shower (b) to the water washing tank (c), respectively.

The wire rod cleaning method of the invention can be adequately performed using the apparatus of this embodiment.

In this embodiment, the at least one pickling tank (a) is provided to perform the step (A) of subjecting the wire rod to acid pickling. The details of the at least one pickling tank are the same as those described herein in the above section "A. Acid pickling step." An example of the at least one pickling tank will also be more specifically described herein in the section "A. Acid pickling step" of EXAMPLES below.

In this embodiment, the high-pressure cleaning shower (b) configured to perform cleaning with pressurized acidic water is provided to perform the step (B) of cleaning the wire rod with pressurized acidic water. The details of the shower (b) are the same as those described herein in the above section "B. High-pressure cleaning step." An example of the shower (b) will be more specifically described herein in the section "B. High-pressure cleaning step" of EXAMPLES below.

In this embodiment, the at least one water washing tank (c) is provided to perform the step (C) of washing the wire rod with water. The details of the at least one water washing tank (c) are the same as those described herein in the above section "C. Water washing step." An example of the at least one water washing tank (c) will be more specifically described in the section "C. Water washing step" of EXAMPLES below.

In this embodiment, the transfer means (d) is configured to transfer the wire rod from the pickling tank (a) to the high-pressure cleaning shower (b) and from the high-pressure cleaning shower (b) to the water washing tank (c), respectively, so that the wire rod cleaning method of the invention can be efficiently performed.

An example of the transfer means (d) is the same as that described herein in the above section "Transfer means."

In the embodiment, the at least one pickling tank (a) preferably includes at least a first pickling tank and a second pickling tank. In addition, a flow channel is preferably provided to supply an acid pickling solution from the second pickling tank to the first pickling tank, and the transfer means (d) is preferably configured to transfer the wire rod from the first pickling tank to the second pickling tank.

When the cleaning apparatus of the embodiment is configured in such a manner, acid pickling is performed in a plurality of pickling tanks, and the wire rod is transferred between the pickling tanks during the acid pickling, which can efficiently produce the advantageous effect that scale is uniformly removed. Additionally, as mentioned above, the wire rod can have a suitable surface roughness, which can lead to the advantageous effect that the optional coating treatment can be uniformly performed, although the reason is not clear. Additionally, when the amount of the acid pickling solution supplied to the second pickling tank is appropriately controlled in this process, the iron ion concentrations in the first and second pickling tanks can be controlled to certain different levels, respectively. This also produces the advantageous effect that the time and labor required for replacing the degraded acid pickling solution can be saved and uniform removal of scale and high surface uniformity can be achieved.

In the embodiment, the at least one pickling tank (a) preferably further includes a third pickling tank in addition to the first and second pickling tanks. In addition, a flow channel is preferably provided to supply an acid pickling solution from the third pickling tank to the second pickling tank, and the transfer means (d) is preferably configured to transfer the wire rod from the second pickling tank to the third pickling tank.

When the cleaning apparatus of the embodiment is configured in such a manner, acid pickling is performed in more pickling tanks, which can produce the advantageous effect that scale is further uniformly removed. Additionally, advantageous effects such as allowing the wire rod to have a suitable surface roughness, improving the uniformity of the coating treatment, saving the amount of the acid pickling solution used, and reducing the amount of wastewater can be more efficiently achieved.

For the same reason, it is preferable to further increase the number of pickling tanks in the embodiment. In more general expression, the at least one pickling tank (a) preferably includes a number of pickling tanks, for example, two to six pickling tanks, a flow channel is preferably provided to sequentially supply the acid pickling solution from one of the two to six pickling tanks to another adjacent pickling tank, and the transfer means (E) is preferably configured to sequentially transfer the wire rod from one of the two to six pickling tanks to another adjacent pickling tank in a direction opposite to that in which the acid pickling solution is supplied.

More specifically, the apparatus of the embodiment may include, for example, a first pickling tank (a1), a second pickling tank (a2), a third pickling tank (a3), a fourth pickling tank (a4), a fifth pickling tank (a5), and a sixth pickling tank (a6). In this case, a flow channel is preferably provided to supply the acid pickling solution, overflowing from one pickling tank (a6), to another adjacent pickling tank (a5), and flow channels are also preferably provided to supply the overflowing acid pickling solution to other adjacent pickling tanks (a4), (a3), (a2), and (a1) sequentially.

On the other hand, the transfer means (E) is preferably configured to transfer the wire rod from the first pickling tank (a1) to the adjacent second pickling tank (a2) in a direction opposite to that of the acid pickling solution supply after the wire rod is subjected to acid pickling in the first pickling tank (a1), and the transfer means (E) is also preferably configured to transfer the wire rod to other adjacent pickling tanks (a3), (a4), (a5), and (a6) sequentially in a direction opposite to that of the acid pickling solution supply.

The cleaning apparatus of the embodiment preferably further includes (e) at least one neutralization tank and (f) means for forming a coating.

In the embodiment, the at least one neutralization tank (e) is used to perform the step (D) of neutralizing the surface of the wire rod, and the means (f) for forming a coating is used to perform the step (E) of forming a coating on the surface of the wire rod. The at least one neutralization tank (e) may be any suitable neutralization tank conventionally used in the field of the art, and the means (f) for forming a coating may also be any suitable coating-forming means conventionally used in the field of the art.

EXAMPLES

Hereinafter, preferred modes of the invention will be more specifically described with reference to examples. It will be understood that the examples below are not intended to limit the invention by any means.

(A. Acid Pickling Step)

Figure 5:
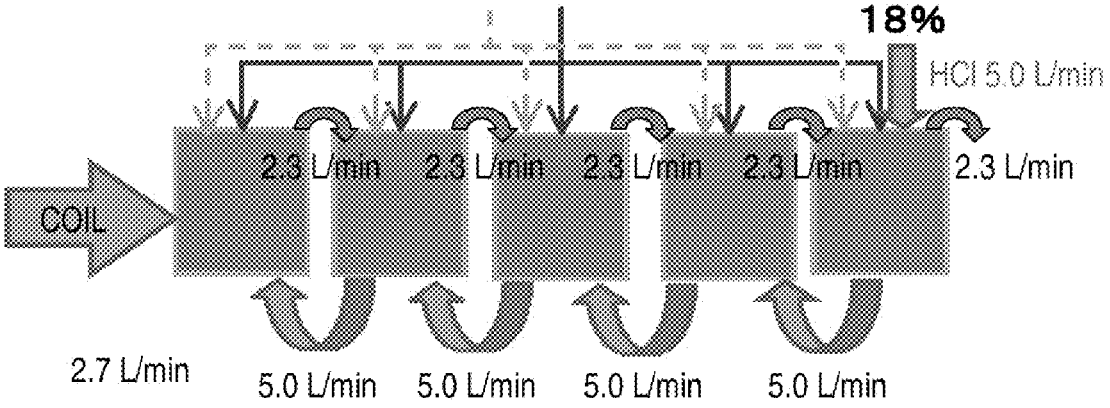
FIG. 5 is a schematic diagram showing a method for replenishing pickling tanks with an acid pickling solution in an embodiment of the invention.

FIG. 5 shows a method for replenishing five tanks with an acid pickling solution in the acid pickling step of an example of the invention.

Figure 6:
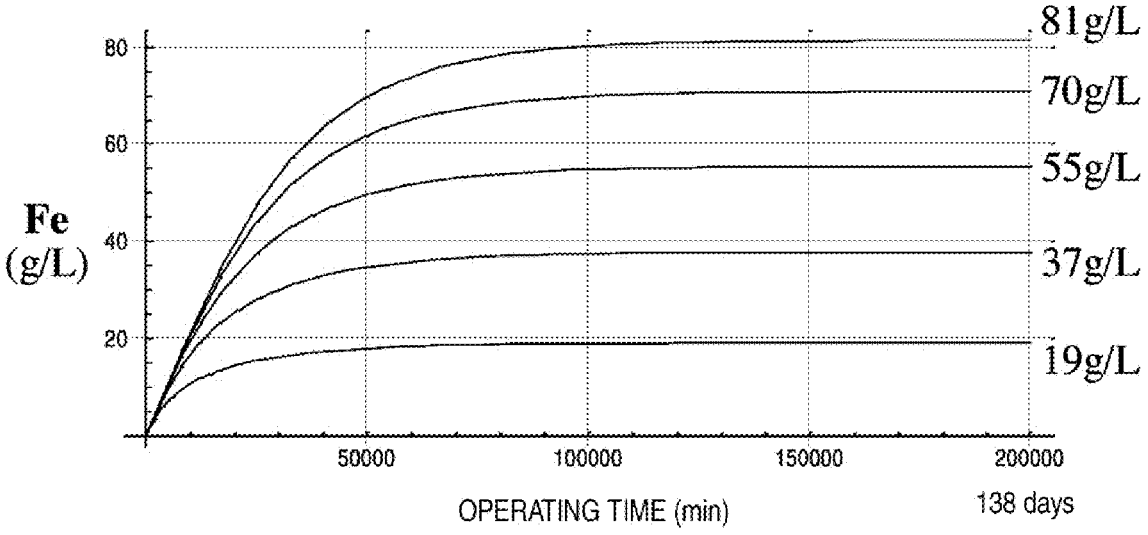
FIG. 6 is a diagram showing changes in the concentration of iron ions in a pickling tank in an embodiment of the invention.

As shown in FIG. 5, the final pickling tank was first replenished with fresh 18% hydrochloric acid at 5 L/minute, and the overflowing acid pickling solution was sequentially supplied to the next upstream pickling tank in a cascade manner. In this process, the amount of iron ions in each tank was measured. FIG. 6 shows the results of the measurement. In each pickling tank, iron ions dissolved at a rate of 50 g/minute.

In the wastewater treatment, 18% by mass HCl is discharged at a rate of 2.7 L/minute.

When acid pickling is performed using this method, iron ions in each pickling tank are controlled to a constant level, and the time and cost required for replacing the degraded acid pickling solution are successfully reduced. Although the reason was not clear as mentioned above, scale was uniformly removed, and the resulting surface uniformity was also good.

(B. High-Pressure Cleaning Step)

Figure 3:
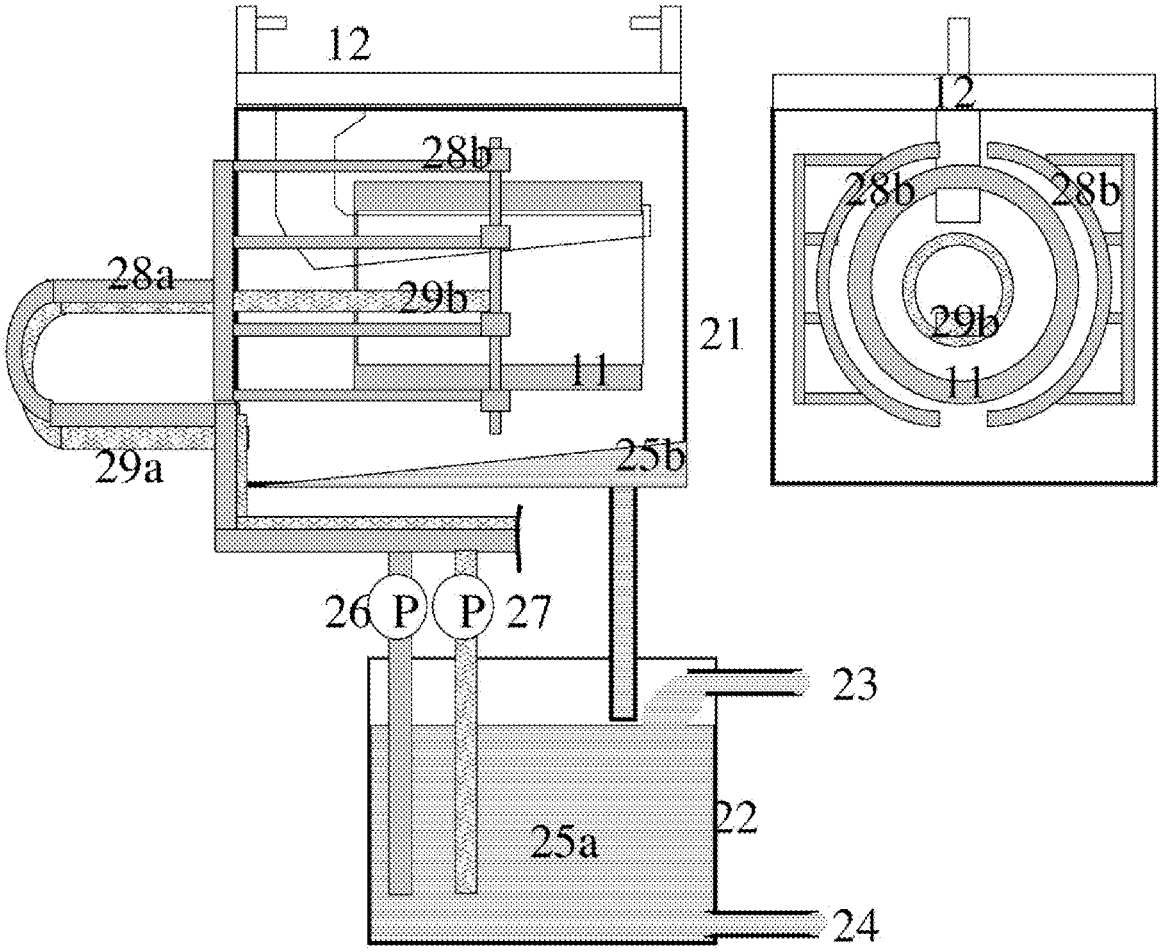
FIG. 3 is a schematic diagram showing the structure of a high-pressure cleaning shower (high-pressure cleaning apparatus) used in an embodiment of the invention.

FIG. 3 shows a high-pressure cleaning apparatus 2, which was used to remove smut from the wire rod 11 in the high-pressure cleaning step of an example of the invention after scale was removed from the wire rod 11.

After subjected to acid pickling for descaling, the wire rod 11 is placed in a high-pressure cleaning shower chamber 21. The shower chamber 21 may be made of any material. For example, the shower chamber 21 may be made of a material having a certain level of durability to the acid pickling solution, such as polypropylene, fiber reinforced plastics (FRP), or a material coated therewith. Smut adhering to the surface of the wire rod is removed as follows. Using pumps 26 and 27, a cleaning liquid 25*a* is supplied through flexible hoses 28*a* and 29*a* and sprayed at high pressure onto the inner and outer sides of the wire rod 11 from a nozzle (not shown) attached to the front end of a high-pressure cleaner 29*b* and from a nozzle attached to the front end of a high-pressure cleaner 28*b*, respectively, so that smut is removed from each side.

The wire rod 11 is placed in the high-pressure cleaning shower chamber 21. The high-pressure cleaning shower chamber 21 is then covered with a member so that the cleaning liquid being sprayed is prevented from leaking out of the chamber 21. Although not shown in FIG. 3, a pedestal is provided to allow the high-pressure cleaners with the flexible hoses 28*a* and 29*a* to move into the chamber.

After the shower cleaning is completed, the cleaning liquid 25*b* returns to a cleaning liquid circulation tank 22. After the shower cleaning, the cleaning liquid 25*b* returning to the cleaning liquid circulation tank 22 has a decreased pH because the acid pickling solution adhering to the wire rod flows down into the cleaning liquid 25*b*.

Fresh filtered water is supplied through an inlet 23 so that the pH of the cleaning liquid in the cleaning liquid circulation tank 22 is returned to a constant value. The excess cleaning liquid 25*a* is discharged from the cleaning liquid circulation tank 22 through an outlet 24 and fed to a wastewater treatment system. Although not shown in the high-pressure cleaning apparatus 2 of FIG. 3, hoses and nozzles are also attached to a ring-shaped, high-pressure, cleaning shower (28*a*, 28*b*, 29*a*, 29*b*) for the right half of the wire rod 11. The cleaner may also be a device having a pair of inner and outer ring-shaped shower tubes, with which cleaning is possible over the entire width of the coil. Although a coil turning device is not shown, it will be understood that the invention is effective regardless of the presence or absence of such a turning device and other components including a mechanism for vibrating the C type hook 12.

The pressure of the pumps 26 and 27 used in the high-pressure cleaning apparatus 2 is preferably, but not limited to, 5 to 10 kg/cm$^2$ (50 to 100 M in total head). The discharge rate of the pumps is preferably 100 to 2,000 L/minute. If the discharge rate is too low, it may take a long time or be difficult to remove smut. If the discharge rate is more than 2,000 l/minute, the effect can be saturated, which is not economical.

The flexible hoses used in the high-pressure cleaning apparatus 2 may be of any acid-resistant type. The pumps and nozzles, which are used to spray a highly-pressurized acidic cleaning liquid, should be made with a material having both high acid resistance and high wear resistance, such as polyvinylidene fluoride, fluororesin, or ceramics.

The amount of the acid pickling solution that adheres to the coil and is carried into the high-pressure cleaning apparatus is about 0.2 L/m$^2$ (per unit area of the coil). If the coil has a diameter of 6.3 mmφ, its surface area is about 80 m$^2$/T, and then the amount of the acid pickling solution carried into the apparatus is about 3.5 L/minute. The wire rod supplied to the acid pickling and coating system has an average diameter of 10 mmφ and thus a surface area of about 51 m$^2$/T. Therefore, the amount of the acid pickling solution carried into the apparatus is 2.3 L/minute.

Figure 4:
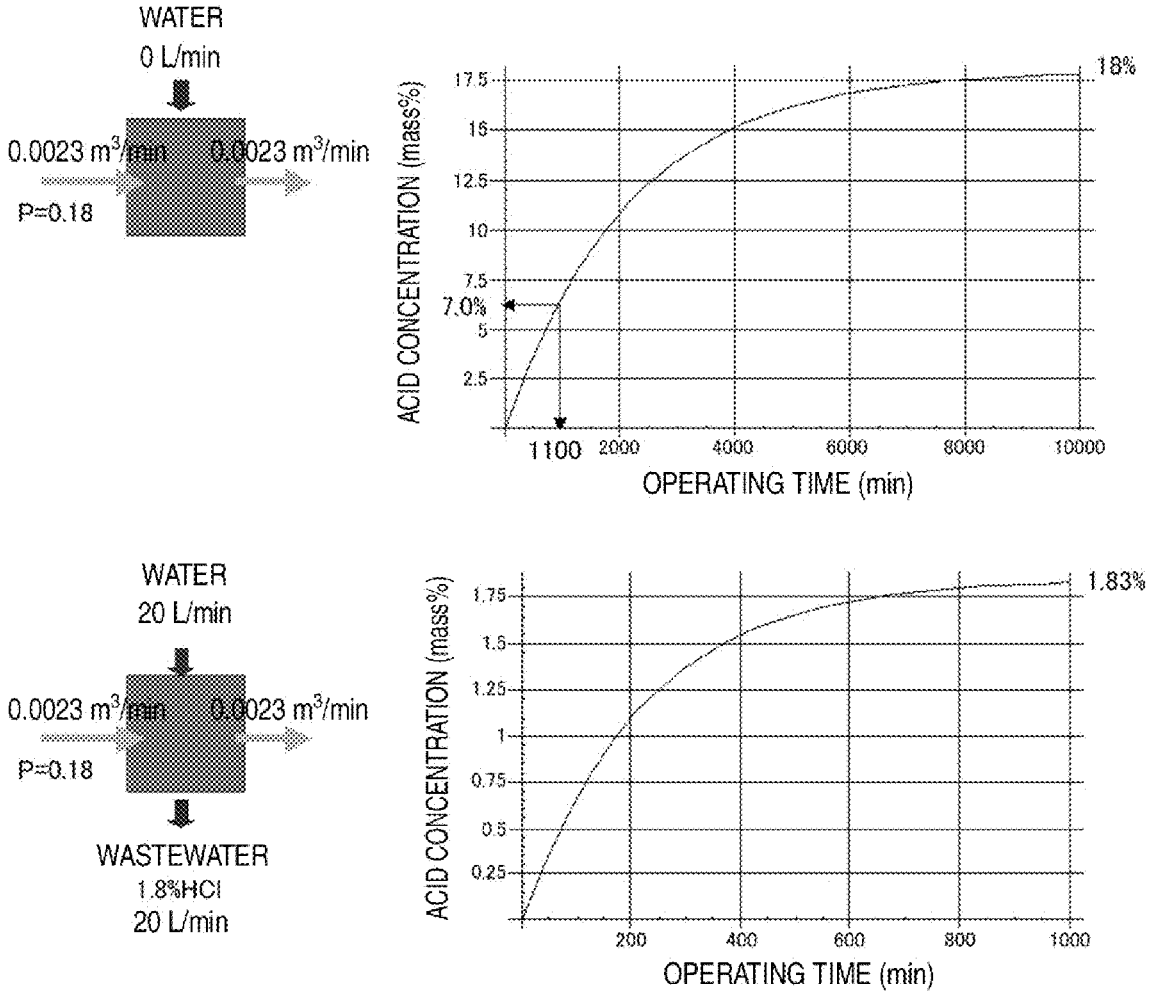
FIG. 4 is a diagram showing changes in the concentration of an acid pickling solution in the high-pressure cleaning apparatus in an example of the invention.

When the cleaning liquid circulation unit 22 has a volume of 5 m$^3$ and when filtered water is not supplied through the inlet 23, the acid concentration in the high-pressure cleaning apparatus reaches 18% by mass after 10,000 minutes (about 7 days) as shown in the upper part of FIG. 4. After 1,100 minutes (about 18 hours), the acid concentration reaches 7% by mass, which is considered to be the upper limit of the most preferred acid concentration in the high-pressure cleaning step according to the invention.

Although not shown in FIG. 4, it has been found that in the following order to maintain the optimum concentration 7% by mass, filtered water should be supplied at a rate of 3.5 L/minute with wastewater being supplied in the same amount to the wastewater treatment. In this case, the amount of wastewater corresponds to 5 m$^3$/day, which is 1/300 of that produced using a conventional continuous treatment (prior to the invention) and 1/100 of that produced using a conventional treatment (prior to the invention) for 2 minutes every 7 minutes, so that the wastewater treatment system cost is significantly reduced.

The same calculation is performed with the volume of the cleaning liquid circulation unit 22 varied in the range of 5 to 7 $m^3$. There is almost no difference between the results. Therefore, the results obtained with a volume of 5 $m^3$, the minimum volume at which the operation can be done without inclusion of air bubbles, have been shown above. Thus, the size of the cleaning liquid circulation unit 22 is not restricted.

In addition, clogging of the nozzles can be prevented if a filter is installed to collect contaminants such as smut at a midway point in the route where the cleaning liquid is returned from the shower chamber 21 to the cleaning liquid circulation unit 22 after it is sprayed.

The lower part of FIG. 4 shows conditions for maintaining the optimum acid concentration 1.8% by mass. It shows that if filtered water is supplied at 20 L/minute while wastewater is supplied at the same rate 20 L/minute to the wastewater treatment, the desired constant acid concentration 1.8% by mass can be maintained.

In this case, the amount of wastewater corresponds to 28.8 $m^3$/day, which is only 1/50 of that produced using a conventional continuous treatment (prior to the invention) and about 1/18 of that produced using a conventional treatment (prior to the invention) for 2 minutes every 7 minutes. The reduction in the amount of wastewater makes it possible to significantly reduce the wastewater treatment system cost.

(C. Water Washing Step)

The surface of the wire rod 11 transferred out of the high-pressure cleaning chamber 21 is slightly acidic although smut is removed from the surface of the wire rod 11. The wire rod 11 in such a state should not be subjected to the post-process. In this example, therefore, three water washing tanks are provided in which a water washing treatment is performed.

Table 1 shows what amount of filtered water should be supplied in the water washing treatment performed before the neutralization. It has been found that if filtered water is supplied at 40 L/minute, the pH in the third water washing tank (WR3) will be almost neutral with no problem in both cases where the amount of the liquid that adheres to the wire rod 11 and is transferred out is 3.5 L/minute (wire rod diameter: 6.3 mmφ) and where it is 2.3 L/minute (wire rod diameter: 10 mmφ).

When the amount of the liquid that adheres to the wire rod 11 and is transferred out is 3.5 L/minute, however, the amount of supply of the filtered water should be slightly increased to 50 L/minute so that butter results can be obtained. In a case where the acid concentration of the high-pressure cleaning shower was about 2%, good results were obtained even when the amount of filtered water was reduced to 20 L/minute in the water washing treatment 3. As a result, the amount of liquid waste transferred to the wastewater treatment was up to 80 $m^3$ L/day, which is only 1/10 of the amount of wastewater produced using a conventional treatment (prior to the invention) for 2 minutes every 7 minutes. The reduction in the amount of wastewater makes it possible to significantly reduce the wastewater treatment system cost.

[Table 1]

TABLE 1

Filtered water supply amount and pH in each water washing tank during water washing treatment

| Amount of 7% HCl transferred | 40 L/min supply of filtered water 40 × 24 × 60 = 57.6 KL/day | | | 50 L/min supply of filtered water 50 × 24 × 60 = 72 KL/day | | |
|---|---|---|---|---|---|---|
| out (pH = −0.28) | WR 1 pH | WR 2 pH | WR 3 pH | WR 1 pH | WR 2 pH | WR 3 pH |
| 3.5 L/min (corresponding to 6 mm ϕ) | 2.8 | 3.8 | 4.9 | 2.9 | 4.0 | 5.2 |
| 2.3 L/min (corresponding to 10 mm ϕ) | 2.9 | 4.2 | 5.5 | — | — | — |
| **Amount of 2% HCl** | **40 L/min supply of filtered water 40 × 24 × 60 = 57.6 KL/day** | | | **20 L/min supply of filtered water 20 × 24 × 60 = 28.8 KL/day** | | |
| transferred out | WR 1 pH | WR 2 pH | WR 3 pH | WR 1 pH | WR 2 pH | WR 3 pH |
| 3.5 L/min (corresponding to 6 mm ϕ) | 4.3 | 5.3 | 6.4 | 4.0 | 4.7 | 5.6 |

WR: Water washing tank

INDUSTRIAL APPLICABILITY

The invention produces the technical effect that scale and smut are appropriately removed from wire rod while the wire rod is prevented from turning yellow after the cleaning, and the amount of wastewater produced by the cleaning can be significantly reduced, which is highly valuable in practical use. Therefore, the invention is highly applicable in various fields of industry, particularly, in the field of manufacture of steel materials.

REFERENCE SIGNS LIST

11 wire rod
12 hook
13 carrying and transferring apparatus
21 high-pressure shower chamber
22 cleaning liquid circulation tank
23 inlet
24 outlet
25 cleaning liquid
26, 27 pump
28*a*, 29*a* flexible hose
28*b*, 29*b* nozzle-supporting pipe

The invention claimed is:

1. A batch-type steel wire rod cleaning method comprising, in the following order, the steps of:

(A) subjecting a steel wire rod, which is coiled and put on a hook for carrying and transferring, to acid pickling by immersing it in an acid pickling solution, wherein the acid pickling solution is hydrochloric acid or sulfuric acid;

(B) cleaning the wire rod with pressurized acidic water, wherein the concentration of the acidic water is adjusted to a constant acid concentration value with an acid pickling solution that has been retrieved as being adhered to the wire rod and collected after it had been used in the step (A) and water, wherein the pressurized acidic water is circulated and reused; and (C) washing the wire rod with water, wherein in the step (A): at least a first pickling tank and a last pickling tank are used; the wire rod is subjected to acid pickling in the first pickling tank, then the wire rod is transferred to the last pickling tank, and the wire rod is further subjected to acid pickling in the last pickling tank; the acid pickling solution adhering to the wire rod from the first pickling tank is transferred to the last pickling tank; and acid pickling solution overflowing from the last pickling tank is supplied to the first pickling tank to supplement a reduced amount of acid pickling solution in the first pickling tank; a new acid pickling solution is supplied only to the last pickling tank; and collection of the pickling solution to be used for adjusting the concentration of the acidic water in step (B) is carried out only from acid pickling solution adhered to the wire rod from step (A); and in the step (B), the pressurized acidic water contains 1.0% by mass to 7% by mass of hydrochloric acid or 1.5% by mass to 10% by mass of sulfuric acid; the pressurized acidic water has a pressure of 3 to 10 kg/cm$^2$; and smut is removed from the wire rod and yellowing of the surface of the wire rod is prevented.

2. The cleaning method according to claim 1, further comprising, following the steps (A) to (C), the steps of:

(D) neutralizing a surface of the wire rod; and/or (E) forming a coating on the surface of the wire rod.

3. The cleaning method according to claim 1, wherein in the step (A):

two to six pickling tanks are used;

the wire rod is subjected to acid pickling in one of the two to six pickling tanks, then sequentially the wire rod is transferred to an adjacent another pickling tank and further subjected to acid pickling, so that the wire rod is subjected to acid pickling in all the two to six pickling tanks;

the acid pickling solution overflowing from one of the two to six pickling tanks is sequentially supplied to an adjacent another pickling tank in a direction opposite to that in which the wire rod is transferred, so that the acid pickling solution is supplied to all the two to six pickling tanks; and wherein the new acid pickling water is supplied only to a last pickling tank in which the wire rod is transferred and the collection of the used pickling solution to be used in step (B) is carried out only from acid pickling solution adhered to the wire rod from in step (A).

4. A method for producing a wire comprising, cleaning a steel wire rod according to the method of claim 1, and cold-drawing the cleaned steel wire rod to produce a wire.

* * * * *